US005182993A

United States Patent [19]

Shiba et al.

[11] Patent Number: 5,182,993

[45] Date of Patent: Feb. 2, 1993

[54] INK SUPPLY SOURCE DRIVING APPARATUS FOR ROTARY PRESSES

[75] Inventors: Noriyuki Shiba, Tokyo; Mamoru Hayashi, Kawasaki, both of Japan

[73] Assignee: Tokyo Kikai Seisakusho, Ltd., Tokyo, Japan

[21] Appl. No.: 782,785

[22] Filed: Oct. 24, 1991

Related U.S. Application Data

[63] Continuation of Ser. No. 484,790, Feb. 23, 1990, abandoned.

[30] Foreign Application Priority Data

Mar. 2, 1989 [JP] Japan ..... 1-48619

[51] Int. Cl.[5] ..... B41F 31/08

[52] U.S. Cl. ..... 101/365; 101/366

[58] Field of Search ..... 101/365, 366, 349, 363

[56] References Cited

U.S. PATENT DOCUMENTS

| | | | |
|---|---|---|---|
| 2,900,900 | 8/1959 | Harless | 101/366 |
| 3,366,051 | 1/1968 | Fusco | 101/365 |
| 3,608,486 | 9/1971 | McDonald et al. | 101/365 |
| 3,636,873 | 1/1972 | Fusco | 101/366 |
| 4,281,597 | 8/1981 | Dressler | 101/365 |
| 4,998,475 | 3/1991 | John et al. | 101/366 |

OTHER PUBLICATIONS

Electric Machines, G. R. Slemon and A. Straughen, pp. 426–427, copyright 1980.

Patent Abstracts of Japan 59.12.03 pp. 208–210—1980.

*Primary Examiner*—Edgar S. Burr

*Assistant Examiner*—John S. Hilten

*Attorney, Agent, or Firm*—Trexler, Bushnell, Giangiorgi & Blackstone Ltd.

[57] ABSTRACT

An ink supply source driving apparatus for rotary presses, capable of reducing the dimensions and weight of a rotary press and carrying out by a single ink supply source driving system an ante-printing rapid ink feeding operation, and an ink pump purging operation for the purpose of carrying out the cleaning of the parts after the completion of a printing operation and the cleaning of the parts for the purpose of replacing the ink by ink of a different color, the apparatus consisting of a synchronizing signal generator adapted to generate when a rotary press driving system in a rotary press is rotated a signal synchronous with the rotation thereof, an ink pump driving motor, a control unit adapted to control the ink pump driving motor selectively so that the ink pump driving motor is driven by an output from the signal generator synchronously with and at a predetermined rotational ratio with respect to the rotation of the rotary press driving system or independently of the rotation of the rotary press driving system, and a change-over means for selectively switching the control modes of the control unit.

1 Claim, 2 Drawing Sheets

INK SUPPLY SOURCE DRIVING APPARATUS FOR ROTARY PRESSES

This application is a continuation of application Ser. No. 07/484,790, filed Feb. 23, 1990, now abandoned.

BACKGROUND OF THE INVENTION

1. Field of the Invention

This invention relates to an ink supply source driving apparatus, for example, an ink pump driving apparatus for rotary presses.

2. Description of the Prior Art

As shown in FIGS. 3 and 4, the driving of ink supply sources, for example, ink pumps 1, 2, 3, 4 in a prior art rotary press in operation is done as the rotation of a printing cylinder (for example, plate cylinder) gear 21 is transmitted to an ink cylinder gear 32 via a gear mechanism 31, then to a driving shaft 13 via a rotary press driving system including, for example, a bevel gear mechanism 33, a worm gear 34 and a clutch 35, and further to the ink pumps 1, 2, 3, 4 via clutches 9, 10, 11, 12 and driving support shafts 5, 6, 7, 8.

On the other hand, in order to feed the ink rapidly before starting a printing operation, carry out the cleaning of the parts after the completion of a printing operation, or purge the ink pumps of the ink for replacing the ink by ink of a different color, the driving gear train constituting the rotary driving system and adapted to transmit the rotation of the printing cylinder gear 21 from the ink cylinder gear 32 to the ink pumps 1, 2, 3, 4 is cut off at, for example, the clutch 35, and the ink supply sources are driven usually at a high speed by a special driving system (including the driving shaft 13, clutches 9, 10, 11, 12 and driving support shafts 5, 6, 7, 8) adapted to transmit power from a special ink supply source driving means (for example, an air motor 36), which is provided independently of the rotary press driving system, to the ink pumps 1, 2, 3, 4.

The driving of the ink supply sources in the above-described prior art rotary press is done by two systems, i.e. a rotary press driving system actuated by an ink cylinder, and a special driving system, and, especially, the driving gear train (especially, the bevel gear mechanism 33, worm gear 34 and clutch 35) in the rotary press driving system has a complicated construction. Consequently, the cost of manufacturing the rotary press becomes high. Moreover, the reliability of this product decreases due to a large number of constituent parts thereof, and it is troublesome to carry out the maintenance work therefor. Since a lot of parts are used for the production of the driving apparatus, a large space is required for providing the apparatus in a rotary press, and the weight of the resultant rotary press increases.

SUMMARY OF THE INVENTION

Therefore, an object of the present invention is to provide an ink supply source driving apparatus for rotary presses, which is free from these drawbacks encountered in a conventional apparatus of this kind.

To achieve this object, the present invention provides an ink supply source driving apparatus for rotary presses, consisting of a synchronizing signal generator adapted to generate when a rotary press driving system in a rotary press is rotated, a signal synchronous with the rotation thereof, an ink pump driving motor, a control unit adapted to control the ink pump driving motor selectively so that the ink pump driving motor is driven by an output from the synchronizing signal generator synchronously with and at a predetermined rotational ratio with respect to the rotation of the rotary press driving system or independently of the rotation of the rotary press driving system, and a change-over means for selectively switching the control modes of the control unit.

When a rotary press is subjected to a printing operation, the rotary press driving system is rotated, and the synchronizing signal generator is energized by the rotation of this driving system, an output signal from this signal generator being inputted into the control unit.

In this case, the change-over means is set to an automatic printing mode.

Consequently, an output from the control unit receiving an output signal from the synchronizing signal generator is inputted into the ink pump driving motor, which is thereby rotated synchronously with and at a predetermined rotational ratio with respect to the rotation of a main driving shaft to drive the ink pumps.

In order to feed the ink to the ink pumps rapidly before starting a printing operation, and carry out an ink pump purging operation for the purpose of cleaning the parts after the completion of a printing operation or replacing the ink by ink of a different color, the change-over means is set to a manual ink pump purging mode.

Consequently, the ink pump driving motor is driven independently with the rotary press driving system in the rotary press not operated, so that the ink pumps are driven to carry out an ante-printing rapid ink feeding operation or an ink pump purging operation.

The above and other objects as well as advantageous features of the invention will become apparent from the following description of the preferred embodiment taken in conjunction with the accompanying drawings.

DESCRIPTION OF THE PREFERRED EMBODIMENT

An embodiment of the present invention will now be described with reference to the drawings.

Figure 1:
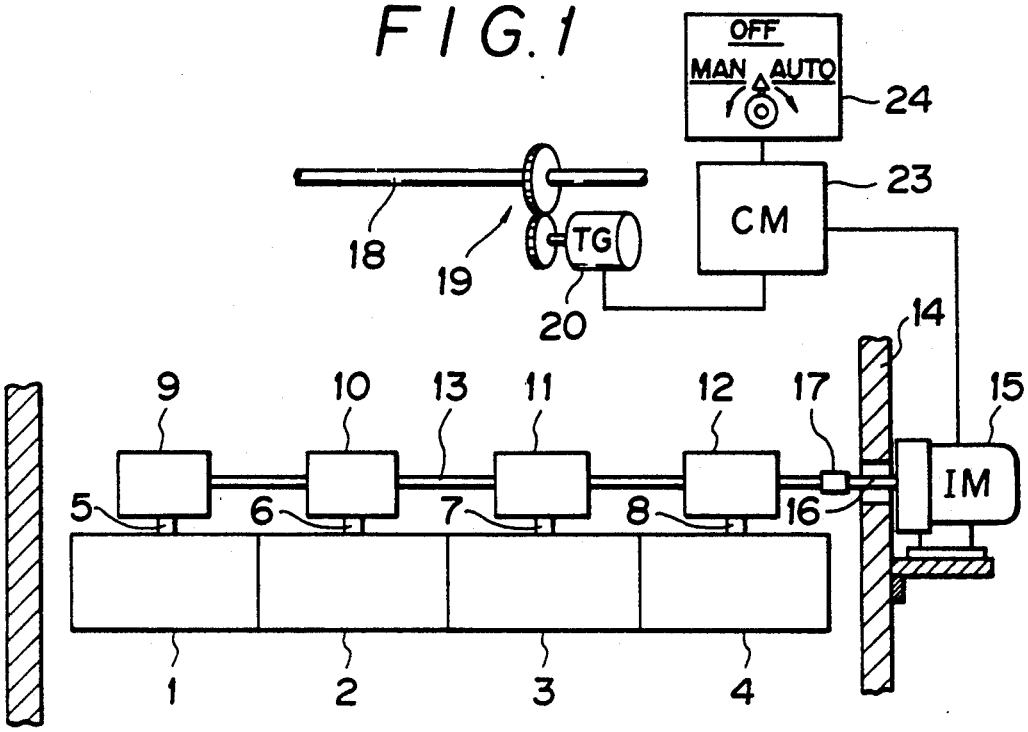
FIG. 1 is a schematic construction diagram in front elevation of an embodiment of the ink supply source driving apparatus for rotary presses according to the present invention.

As shown in FIG. 1, the driving support shafts 5, 6, 7, 8 of ink pumps 1, 2, 3, 4, which are arranged in a row and independently of one another so as to supply ink to an ink rail (now shown) in a rotary press every time the page to be printed is changed, are joined to a common driving shaft 13, which is provided in parallel with the ink rail, via clutches 9, 10, 11, 12 capable of being engaged and disengaged separately. The driving shaft 13 is connected at one end thereof to a shaft 16 of an inverter control motor 15, which is provided on the outer side of a frame 14, via a joint 17. Apart from these parts, a pulse signal generator 20 is provided, which is adapted to be actuated by and at a predetermined rotational ratio with respect to the rotation of one main driving shaft, for example, an ink cylinder shaft 18 in a rotary press driving system in the rotary press via a gear mechanism 19.

Figure 2:
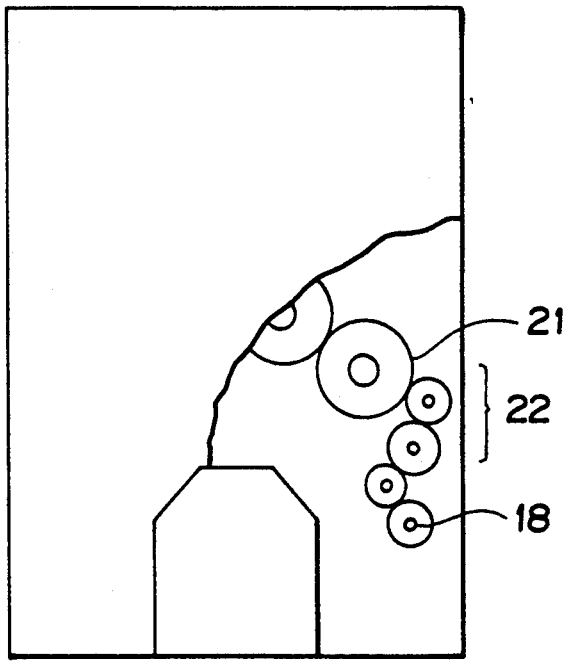
FIG. 2 is a schematic construction diagram in side elevation of the embodiment of the ink supply source driving apparatus for rotary presses according to the present invention.
Figure 3:
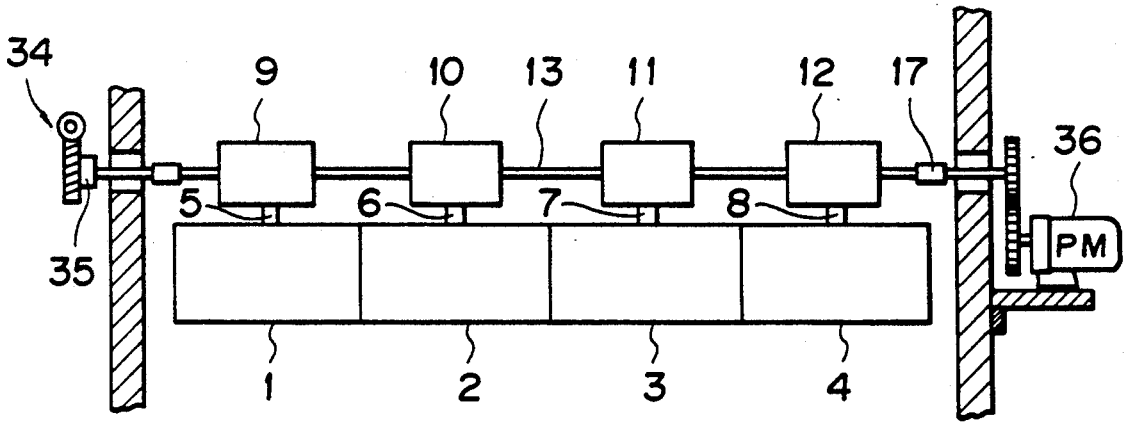
FIG. 3 is a schematic construction diagram in front elevation of an ink supply source driving apparatus for a prior art rotary press.
Figure 4:
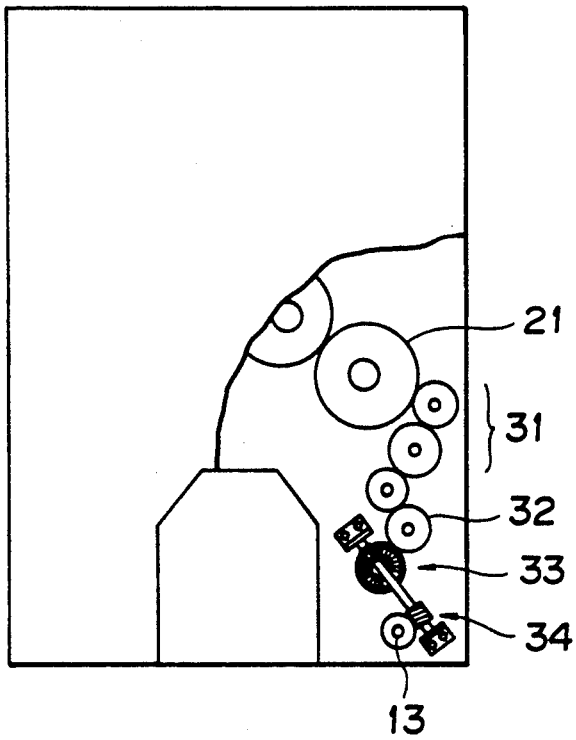
FIG. 4 is a schematic construction diagram in side elevation of the ink supply source driving apparatus for a prior art rotary press.

The ink cylinder shaft 18 is adapted to be rotated as shown in FIG. 2, which shows an example thereof, by a printing cylinder (for example, a plate cylinder) gear 21 via a gear mechanism 22.

The input terminal of the inverter control motor 15, the output terminal of the pulse signal generator 20, and the output terminal of a selecting switch 24, which is adapted to be shifted to three kinds of modes, i.e. an automatic mode A, a manual mode B and a non-operating mode C, are connected to an inverter control unit 23.

The operation and effects of this ink supply source driving apparatus for rotary presses will now be described.

While the rotary press is in a printing operation, the ink cylinder 18 is rotated in accordance with the rotation of the printing cylinder (for example, plate cylinder) gear 21 via the gear mechanism 22, and the rotation of the shaft 18 causes the pulse signal generator 20 to be rotated via the gear mechanism 19, an output signal from the pulse signal generator 20 being inputted into the inverter control unit 23.

In this case, the selecting switch 24 is set to the automatic mode A for carrying out a printing operation.

Consequently, an output from the inverter control unit 23 which has received an output signal from the pulse signal generator 20 is inputted into the inverter control motor 15, which is rotated synchronously with and at a predetermined rotational ratio with respect to the rotation of the ink cylinder shaft 18 to rotate the driving shaft 13.

When the driving shaft 13 is thus rotated, the driving support shafts 5, 6, 7, 8 which correspond to the clutches 9, 10, 11, 12 in a selectively engaged state, are rotated via these clutches, and the ink pumps 1, 2, 3, 4 relative to the same driving support shafts are driven, the ink being thereby supplied to the ink rail (not shown) every time the page to be printed is changed.

In order to feed the ink to the ink pumps rapidly before starting a printing operation, and carry out an ink pump purging operation for the purpose of cleaning the parts after the completion of a printing operation or replacing the ink by ink of a different color, the selecting switch 24 is set to the manual ink pump purging mode B.

As a result, the rotary press driving system in the rotary press is not operated, and the inverter control motor 15 is driven independently with one main driving shaft, for example, the ink cylinder shaft 18 in the rotary press driving system not operated. Consequently, the driving shaft 13 is rotated, so that the ink pumps 1, 2, 3, 4 are driven at a suitable predetermined speed in the same manner as mentioned above.

According to the present invention, the ink supply source driving apparatus for rotary presses has only one ink supply source driving system, so that it is unnecessary to provide a complicated driving system. Therefore, all kinds of operations including a regular printing operation as well as a preparatory operation therefor, such as an ante-printing rapid ink feeding operation and an ink pump purging operation for the purpose of carrying out the cleaning of the parts after the completion of a printing operation and the cleaning of the parts for the purpose of replacing the ink by ink of a different color can be carried out by one driving system.

The construction of this apparatus is thus simplified, so that the cost of manufacturing the rotary press decreases. Moreover, the maintenance work can be carried out easily, and the space saved owing to the success in omitting unnecessary parts can be utilized significantly, the weight of the rotary press being reduced greatly.

The present invention is not, of course, limited to the above embodiment; it may be modified in various ways within the scope of the appended claim.

What is claimed is:

1. An ink supply source driving apparatus for driving a plurality of ink pumps in a rotary press, comprising: a synchronizing signal generator having means for generating a signal synchronous with the rotation of a driving system of said rotary press, an ink pump driving motor which comprises an inverter control motor having an output shaft, a common drive shaft coupled directly to said output shaft, a plurality of clutches coupled to be driven by said common drive shaft, each of said clutches having means for being engaged and disengaged separately and each of said clutches being operatively coupled for driving one of said ink pumps, a control unit having means for operating said ink pump driving motor selectively in a first control mode wherein said ink pump driving motor is driven by an output from said synchronizing signal generator synchronously with and at a predetermined rotational ratio with respect to the rotation of said rotary press driving system and a second control mode wherein said ink pump driving motor is driven independently of the rotation of said rotary press driving system, and a change-over means for selectively switching control modes of said control unit between said first control mode and said second control mode.

* * * * *